US007581996B1

(12) United States Patent
Boller

(10) Patent No.: US 7,581,996 B1
(45) Date of Patent: Sep. 1, 2009

(54) KAYAK AND CANOE PADDLING APPARATUS

(76) Inventor: Keith Luebkert Boller, 1226 Montego St., Arroyo Grande, CA (US) 93420-2435

( * ) Notice: Subject to any disclaimer, the term of this patent is extended or adjusted under 35 U.S.C. 154(b) by 115 days.

(21) Appl. No.: 11/890,341

(22) Filed: Aug. 6, 2007

(51) Int. Cl.
*B63H 16/00* (2006.01)

(52) U.S. Cl. ..... 440/104

(58) Field of Classification Search ..... 440/101, 440/104, 108, 105
See application file for complete search history.

(56) References Cited

U.S. PATENT DOCUMENTS 287,088 A * 10/1883 Beckers ..... 440/104
2,083,004 A * 6/1937 Clark ..... 440/104
3,324,490 A * 6/1967 Jewett ..... 440/101
5,215,482 A * 6/1993 Henry ..... 440/104
5,647,782 A * 7/1997 Henry ..... 440/104
6,113,447 A * 9/2000 Roy et al. ..... 440/104
6,857,922 B2 * 2/2005 Fernandez ..... 440/101

* cited by examiner

*Primary Examiner*—Lars A Olson

(57) ABSTRACT

This is an apparatus to paddle a kayak, canoe, or other small watercraft, employing twin paddles, joined at the upper portion. A locating arm, connected to this juncture, and also to an anchor point at or near the bow, restricts fore/aft movement, in effect creating a "third hand". In use, this allows paddling with reduced motion, effort, fatigue, craft yaw, and inboard water incursion.

1 Claim, 1 Drawing Sheet

1
2
3
4
5
6
7
8
9
10
11
12

KAYAK AND CANOE PADDLING APPARATUS

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

The field of endeavor to which this invention pertains is manual propulsion of small watercraft.

One-person kayak and canoe paddling has several deficiencies. In order to mitigate yaw, the double-bladed kayak paddler must perform an exaggerated movement, elevating the paddle nearly vertically in order to stroke as closely as possible to the side of the craft, while the raised end trails water inboard.

The single-bladed canoe paddler must switch hand positions for each side's stroke, again trailing water inboard at the crossover.

There is a need for an invention both to reduce arm movements, as well as mitigate water incursion. No prior art addressing this has been found.

BRIEF SUMMARY OF THE INVENTION

The apparatus presented here fulfills the above stated needs with a simple and effective solution.

The invention is comprised of a pair of single-bladed paddles, which are joined at the upper portion, with the blade faces facing the same direction, and loosely connected to a locator arm. When anchored, this arm restricts front-to-back movement of the upper portion, functioning as a "third hand", and thus creating a lever of the third class when paddling. The paddle shafts are grasped at a comfortable position below the joined parts, and are free to move in all other directions. Sequential or simultaneous paddling may be performed, with the blade faces maintaining their orientation, and with minimal arm and hand movement, without water incursion.

BRIEF DESCRIPTION OF THE SEVERAL VIEWS OF THE DRAWING

3 Common snap hook
4 Anchor eyebolt
5 Paddle shaft
FIG. 2 Detail of paddle shaft junction 2.
6 Eyebolt
7 Spacer
8 Locknut
FIG. 3 Enlarged view of snap hook 3.

DETAILED DESCRIPTION OF THE INVENTION

Figures 1, 2, 3, 4, 5:
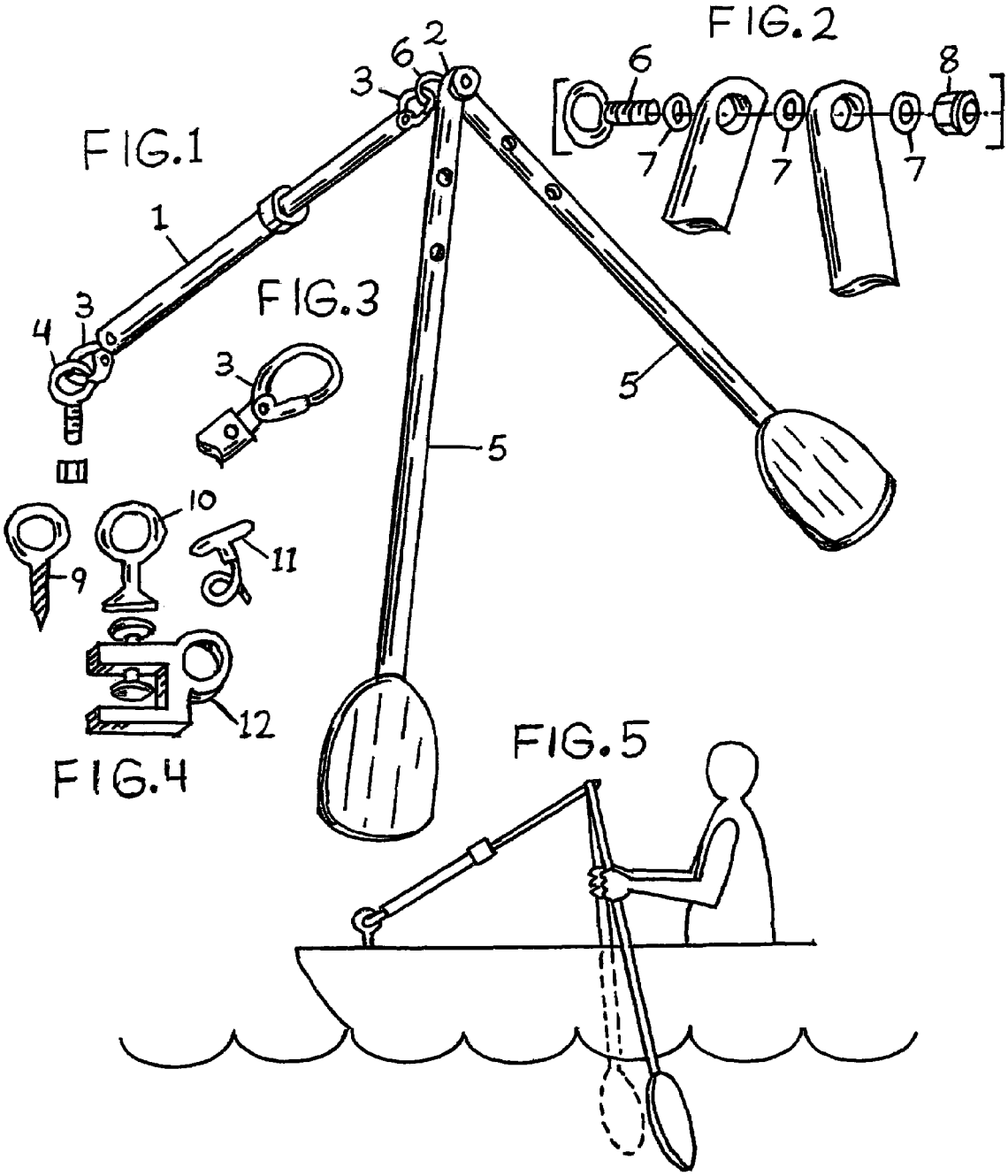
FIG. 1 Is a perspective view of the apparatus.
1 Locator arm
2 Paddle shaft junction
FIG. 4 Alternate anchor methods.
9 Screweye
10 Glued eye
11 Kayak tow handle
12 Clamp with eye
FIG. 5 Apparatus in operation.

The invention consists of a pair of paddles 5, preferably of light metal or plastic. An eyebolt 6 joins the paddle shafts at their upper portion FIG. 2 in one pair of holes, with spacers 7 and locknut 8, with the paddle blade faces oriented in the same direction. The connection is snug, while still allowing easy spreading of the paddles to accommodate beam width variations.

The essential component is the locator arm 1, preferably of light metal or plastic, telescoping for adjustability, with a common-type threaded compression collar.

Common-type snap hooks 3 connect the locator arm 1 to the paddles at eyebolt 6, and to the anchor eyebolt 4, or alternate anchoring methods FIG. 4.

In operation the paddles are swung outward and raised to re-deploy. There is no need to reposition the hands. Pulling propels craft forward; pushing, backward.

Materials and dimensions may be varied. The prototype employs 60" wooden-shaft paddles with plastic blades, and the locator arm has multi-holed, overlying wood strips for adjustability, and functions satisfactorily, easily accommodating a pontoon raft with 40" beam.

What I claim as my invention is:

1. An apparatus to simplify the orientation of paddle shafts and blades for optimum forward-facing manual propulsion of small watercraft, comprising:

a tubular, telescopically-adjustable member, described as a locator arm, having a snap-hook attached at each end;

said member being loosely connected at a bow area of said watercraft by way of an existing or attachable eyebolt, screweye, glued eye, or eye-clamp;

said member being loosely connected at its rear to an eyebolt, said eyebolt snugly joining an upper portion of said paddle shafts, with said blades disposed at right angles to the water, the looseness of said connections permitting free movement for propulsion.

* * * * *